United States Patent [19]

Weisman et al.

[11] Patent Number: 5,015,090

[45] Date of Patent: May 14, 1991

[54] CENTERING APPARATUS FOR A GEMSTONE

[76] Inventors: Ilan Weisman, 52 Brener Street, Herzelia; Roni Shapira, Moshav Givat-Chen, Ranana; Roni Shafir, 9 Leon Blum Street, Ramat-Aviv; Hanoh Shtark, 23 Lamerchav Street, Ramat Hasharon, all of Israel

[21] Appl. No.: 366,927

[22] Filed: Jun. 16, 1989

[30] Foreign Application Priority Data

Jun. 16, 1988 [IL] Israel ..... 86762

[51] Int. Cl.[5] ..... G01N 21/00

[52] U.S. Cl. ..... 356/30

[58] Field of Search ..... 356/30, 127, 394, 399, 356/400; 125/30.01; 358/107

[56] References Cited

U.S. PATENT DOCUMENTS

| | | | |
|---|---|---|---|
| 4,110,937 | 9/1978 | Bein | 51/229 |
| 4,233,625 | 11/1980 | Altman | 356/400 |
| 4,417,564 | 11/1983 | Lawrence et al. | 356/30 |
| 4,651,203 | 3/1987 | Peterson | 356/399 |

FOREIGN PATENT DOCUMENTS

| | | |
|---|---|---|
| 861611 | 12/1977 | Belgium . |
| 0089212 | 9/1983 | European Pat. Off. . |
| 0098735 | 1/1984 | European Pat. Off. . |
| 65996 | 4/1979 | Israel . |
| 2074480 | 11/1981 | United Kingdom . |
| 2080712 | 2/1982 | United Kingdom . |

*Primary Examiner*—Richard A. Rosenberger

*Attorney, Agent, or Firm*—Pollock, Vande Sande & Priddy

[57] ABSTRACT

A method and apparatus for sorting and centering unfinished gem stones for working in an automatic working machine includes the steps of viewing the stone in a direction parallel to the axis of centering and providing an image corresponding to the circumference thereof, superimposing the image on a reference center image, providing a reference circumference shape centered about the reference center, changing the relative size of the reference shape, preferably by computerized means, until it can fit within the image of the stone, and moving the stone until it is centered about the reference center.

23 Claims, 3 Drawing Sheets

CENTERING APPARATUS FOR A GEMSTONE

FIELD OF THE INVENTION

The present invention relates to an apparatus for centering and sorting gem stones for working on automatic or other types of grinding, polishing or finishing machines.

BACKGROUND OF THE INVENTION

Automatic grinding and polishing machines for gem stones are known. These generally include a plate for holding a plurality of dops in a horizontal row, means for rotating the dops around their respective longitudinal axes, and means for pivoting the plate such that gem stones mounted on the dops move in and out of engagement with a grinding or polishing wheel or belt in accordance with a pre-determined sequence.

These machines are much faster than manual grinding and polishing. On the other hand, no individual treatment of stones is possible. Thus, in order for use of the machine to be economically feasible, stones of approximately the same size must be worked together (so as to avoid removing too much material from a relatively large stone or insufficient working of a relatively small stone). In addition, the stones must be accurately centered on the dops to permit efficient working of each stone. Finally, all the stones must be disposed in the machine with their tables in a sensible identical plane.

At present, centering and affixing the stones on the dops are generally performed manually, depending exclusively on the worker's skill and eye. This leads to a certain amount of error, resulting in stones which either must be rejected or reworked to a smaller size. Thus, use of such machines today is economical only where the stones to be worked have relatively little value so that human errors are relatively inexpensive.

There is known a device called a comparator which comprises an illuminated screen on which a grid is defined. A stone may be held in front of the comparator and viewed from a direction perpendicular to the axis of centering to permit visual centering by an operator. Furthermore, in order to examine a stone relative to a plurality of shapes or sizes, a different reference image must be manually affixed to the comparator for each comparison.

SUMMARY OF THE INVENTION

It is an object of the present invention to provide an apparatus and method for aiding in the manual centering of gem stones on dops for use in automatic grinding or polishing machines, or the like, which is easy to operate yet provides substantially improved centering as well as sorting of stones than is possible by the technician alone or by known mechanical techniques.

It is a further object of the invention to provide means for preparing the stones for automatic machining by locating the tables of all the stones in a single plane, which may include inverting the stones onto their individual dops.

There is thus provided in accordance with the present invention a method for sorting and centering unfinished gem stones for working in an automatic working machine including the steps of viewing the stone in a direction parallel to the axis of centering and providing an image thereof, superimposing the image on a reference center image, providing a reference shape centered about the reference center, automatically changing the relative size of the reference shape, preferably by computerized means, until it can fit within the image of the stone, and moving the stone until it is centered about the reference center.

According to a preferred embodiment, the method further includes the steps of recording the final size of the reference shape, estimating the maximum possible height of the finished stone, and recording this height.

Most preferably the method further includes the step of comparing the selected size and maximum height with a plurality of pre-determined sets of parameters and selecting the most appropriate set of parameters for the stone in accordance therewith, prior to the step or recording.

The method preferably further includes gluing the centered stone on a dop, either in the orientation in which it was centered or after inversion.

According to one embodiment, the method includes the steps of coupling the stone to an aperture in a base plate having suction means to retain the stone in place, viewing the gem stone from above parallel to its longitudinal axis and transmitting an image signal corresponding thereto via a computer to a screen for viewing, providing a reference center on the screen on which the image is superimposed, the reference center corresponding to the center of the aperture, providing a reference shape on the screen centered about the reference center and superimposed on the stone image, varying the size of the reference shape until the largest shape which will fit inside the stone is determined, and moving the stone relative to the aperture until the stone image is centered about the reference center.

There is also provided in accordance with the present invention apparatus to aid in manual centering of an unfinished gem stone including apparatus for viewing the stone in a direction parallel to the axis on which the stone is to be centered and providing an image thereof to a computer and associated viewer, the computer including apparatus for generating a reference center image, for providing a reference shape centered about the reference center and for superimposing the stone image on the reference center, apparatus for changing the relative size of the reference shape on command from an operator, and apparatus for providing a visual output corresponding to a selected size.

The apparatus further includes apparatus for automatically moving a new stone into position for examination when the previous examination has been completed.

According to a preferred embodiment, the apparatus further includes apparatus for estimation of the maximum possible height of the finished stone, which may be manual, mechanical, optical or any other apparatus, and provide an output signal corresponding thereto to the computer.

Further according to a preferred embodiment, the apparatus also includes apparatus for gluing the centered stone on the dop. This apparatus may include means for inverting the sorted stone before gluing its opposite side to a dop in its centered orientation.

There is further provided in accordance with the present invention apparatus for centering and sorting an unfinished gem stone including a base plate defining at least one aperture coupled to a vacuum source, viewer apparatus arranged to view a gem stone coupled to the aperture in a direction parallel to the axis about which the stone is to be centered and provide an output signal corresponding thereto, computer apparatus arranged to receive said output signal and transmit an image corresponding thereto to a visually observable monitor, apparatus for providing a reference center on the monitor superimposed on the image, apparatus for providing reference shapes corresponding to various configurations of circumferences of finished stones centered about the reference center and associated apparatus for permitting alteration of the shape or relative size of the reference shape by an operator until the optimum size is reached, and apparatus for recording this optimum size.

According to a preferred embodiment, the apparatus further includes apparatus for viewing or otherwise sensing the stone perpendicular to the axis of centering and providing maximum height data of the stone to the computer, and apparatus for recording this maximum height.

Further according to a preferred embodiment, said computer apparatus is arranged to provide an output signal correponding to one of a plurality of pre-determined sets of shape, height and size parameters of a finished stone.

According to a preferred embodiment, the base plate includes a ruler defining at least one aperture coupled to a vacuum source, at least one stone holder associated with the aperture and retained thereon by vacuum, and wherein the center of the aperture corresponds to the reference center projected on the screen.

Preferably the ruler defines a plurality of apertures arranged for serial viewing by the viewer and apparatus for advancing the ruler so that one stone is viewed after the other. In this embodiemnt, the movement of the ruler could be automatically controlled by the computer and actuated by the operator.

Further according to a preferred embodiment, the apparatus includes apparatus for gluing a centered gem stone on a dop including a ruler support and at least one dop support channel disposed such that the longitudinal axis of a dop supported thereon intersects the center of the aperture in the ruler when mounted in the ruler support.

According to one embodiment, the stone is glued onto the dop directly from the ruler on which it is centered. According to another embodiment, the gluing apparatus further includes a second ruler defining at least one aperture in registration with the at least one aperture of the first ruler and arranged to be inverted before mounting on the ruler support for gluing the stones in an inverted orientation.

BRIEF DESCRIPTION OF THE DRAWINGS

The present invention will be further understood and appreciated from the following detailed description taken in conjunction with the drawings in which.

DETAILED DESCRIPTION OF THE INVENTION

Figure 1:
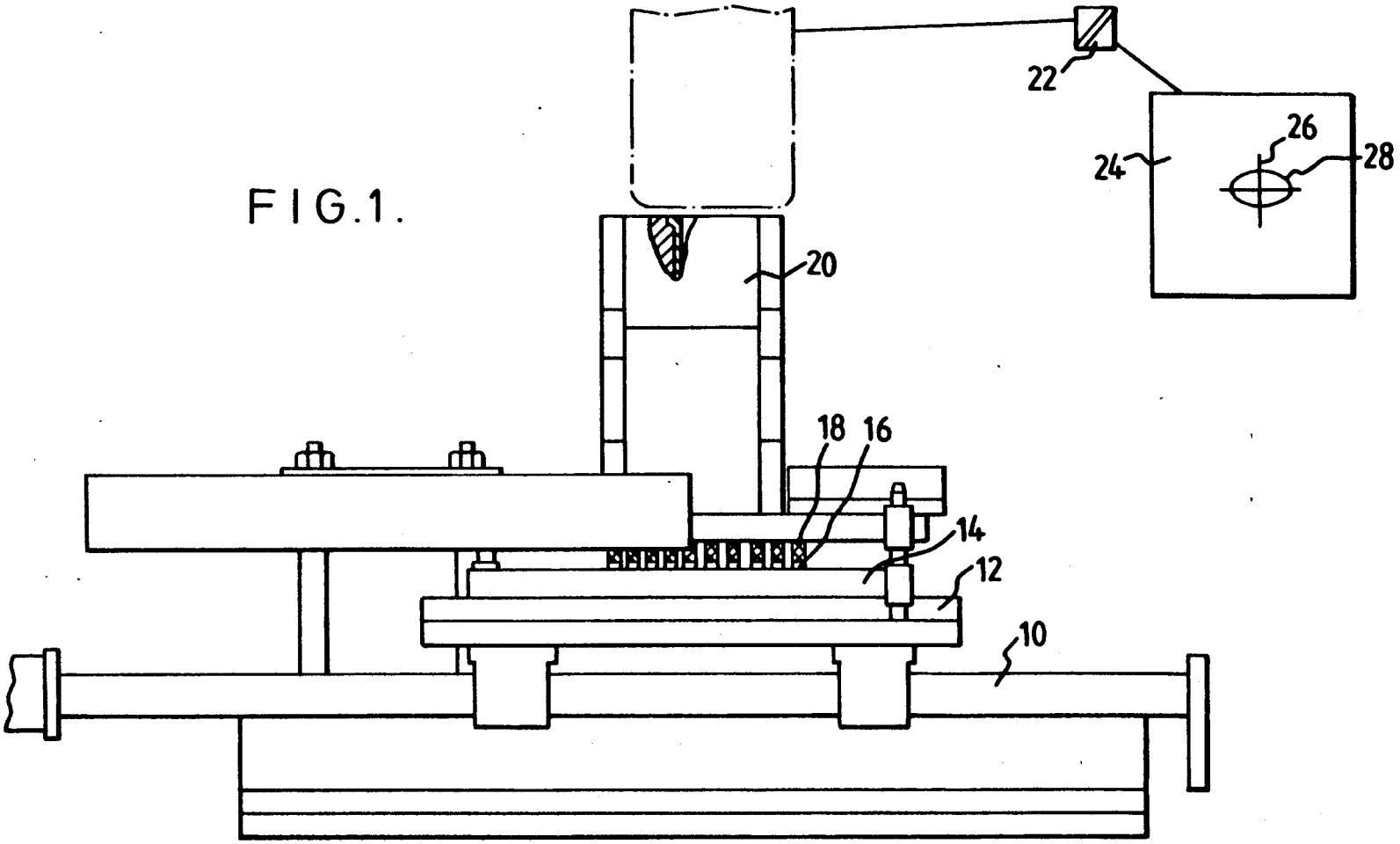
FIG. 1 is a front view of apparatus for centering unfinished gem stones constructed and operative in accordance with the present invention.

The present invention relates to a method and apparatus for centering and sorting unfinished gem stones for subsequent working in an automatic grinding or polishing machine or other working machine. Essentially, this apparatus is a tool for use by the worker in manually centering the stones and gluing them onto a dop or holder in such a way that the table of each stone lies in the same plane.

The method comprises viewing the entire stone from a direction parallel to the axis of centering. Most preferably, the stone is illuminated from one direction and viewed in such a manner that the silhouette of its circumference can be seen as projected on a screen associated with the viewer. A reference center, which corresponds to the center of the stone holder and, eventually, of the dop, is shown on the screen superimposed on the image of the stone.

The operator may manually move the stone until it is roughly centered about the reference center, although this is not necessary. The operator causes reference shapes of his choice corresponding to the shape and size of the circumference of a plurality of finished stones to be generated on screen centered about the reference center. The size of the reference shape is altered by the operator until a size is reached which can fit entirely within the stone image. The stone is now moved until it is centered about the reference center, with the reference shape fitted entirely therewithin. The selected stone size and shape is now recorded in computerized recording means.

It is a particular feature of the present invention that the reference shapes can be called up instantly from the memory of the processor for comparison by the operator, and that the size can be adjusted at the touch of a button. This feature is not present in known manual centering devices.

According to a preferred embodiment, the maximum height of the stone beneath its center is now sensed perpendicular to the axis of centering in order to determine whether adjustments to the height need to be made due to the shape, particularly asymmetry, of the particular stone. A reference height line may be provided on the screen which can be lowered manually by the worker or a mechanical height sensor can be manually lowered onto the stone, until the maximum estimated height of the finished stone at its center has been determined. This data is also recorded.

These three pieces of information, shape, size and height, are now compared with a plurality of sets of pre-determined parameters for stones to be worked by the machine. (Each automatic machine operates on a limited number of shapes and sizes of stone, each size range having its own working instructions.) The stone will be categorized with the set of parameters providing the largest possible stone, or other sorting criterion, taking into account the size and height data.

Once the centering is completed and the stone has been categorized or sorted, the stone must be glued onto the dop in such a way as to also be centered thereon. The direction of working of the stone, such as, beginning with the crown or culet side, will determine the particular procedure for gluing, as described in greater detail hereinbelow.

Figure 2:
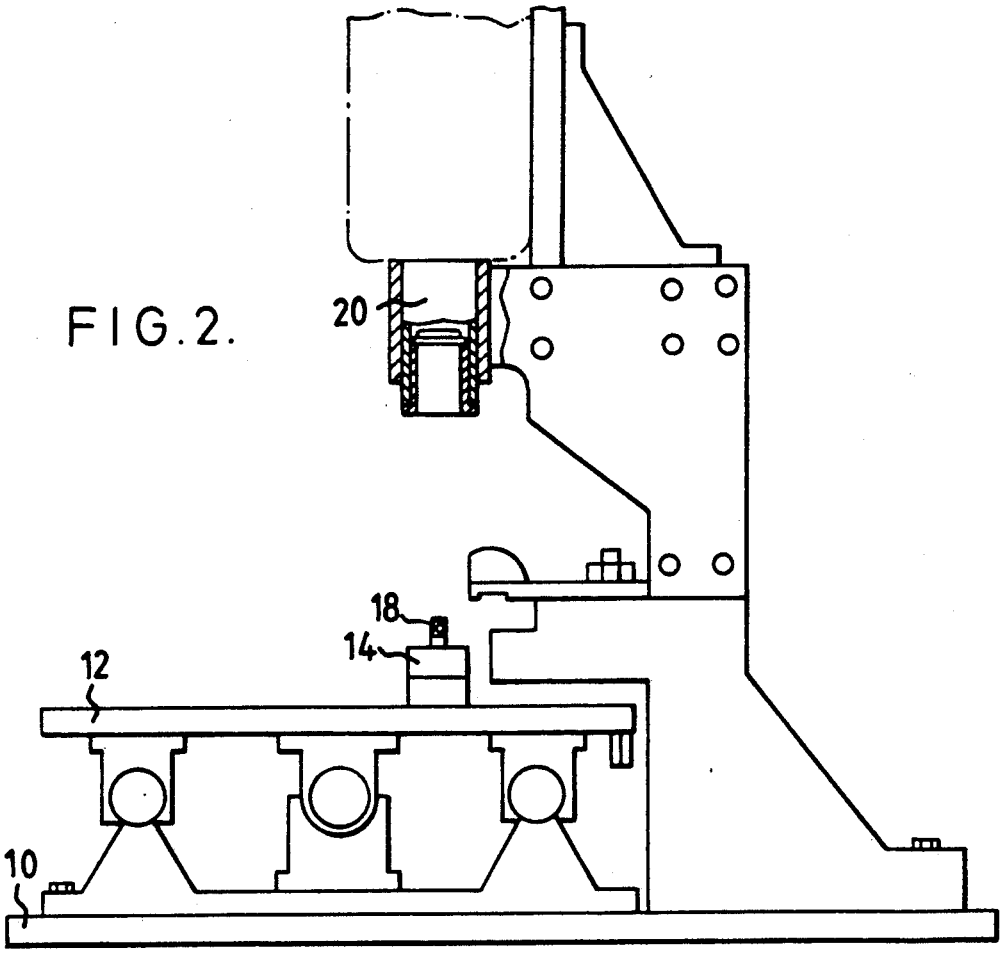
FIG. 2 is a side view taken along line A—A in FIG. 1.

Referring now to FIGS. 1 and 2 there is shown apparatus for centering and sorting unfinished gem stones constructed and operative in accordance with the present invention. The apparatus comprises a base 10 on which is mounted a slideable table 12. Mounted on slideable table 12 is a ruler 14 defining a plurality of equidistantly spaced apertures 16 and coupled to a vacuum source (not shown). Disposed on ruler 14 are a plurality of stone holders 18. Stone holders 18 may comprise inverted cups defining an aperture therein in the upper surface whereon the stones may be placed and retained in position by the suction force of the vacuum.

It will be appreciated that the center of each aperture 16 defines the central axis about which the stone mounted thereon is to be centered.

Disposed above stone holders 18 is a viewer 20 having an associated illumination source (not shown). Viewer 20 may comprise a video camera or any other suitable optical shape identifier adapted to view the circumference of a stone disposed on the stone holder and transmit a signal corresponding to the image thereof to a computer 22. Computer 22, in turn, is coupled to a screen 24 on which the image of the stone viewed by viewer 20 is displayed.

Computer 22 comprises means for displaying a reference center 26, such as a cross, on screen 24. The center 26 corresponds to the center of aperture 16. Computer 22 also comprises means for generating a plurality of reference shapes 28, such as a circle or oval or any other shape, representing the circumference or girdle of the finished stone, together with means operable by the worker to alter the size of the reference shape 28.

As can be seen in FIG. 1, the worker is required to move the holder 18 on which a stone 15 is disposed until its image is centered about reference center 26, and to alter the size of the selected reference shape 28 until it fits within the image of the stone. The stone is thus centered with reference to ruler 14 and aperture 16, and the selected shape and size are recorder in computer 22. It will be appreciated that the size of the reference shape may be determined before or after the stone is centered about the reference center.

As described above, worker interaction is required to center the stone 15 image about the reference center. This procedure may also be carried out entirely automatically by the computer, since it may be supplied with the stone 15 image with respect to coordinates representing displacement from the reference center. The computer can then generate the reference shapes with respect to these coordinates, and once the reference shapes are compared with the stone 15 image, the appropriate shape is chosen along with the known displacement from the reference center. Thus, the coordinates needed for centering the stone are provided and the stone 15 can be moved accordingly.

Ruler 14 now advances so as to move the next uncentered stone into place beneath the viewer. Sliding table 12 is mounted for axial motion on a screw axle actuated by a step motor and monitored by an encoder (not shown). The computer 22 directs the operation of the step motor and, accordingly, the translation of table 12. The centering process is repeated as above until all the stones disposed on the ruler have been centered.

Sorting of the stones depends also upon the maximum height of the stone at its center. Each stone in turn, either immediately after centering or after the entire group has been centered, is measured perpendicular to the axis of centering to estimate the maximum height. This data is recorded in computer 22 together with the size and shape data and, as discussed hereinabove, the appropriate set of pre-determined parameters is assigned to the stone. This determination of the most appropriate parameters for the finished stone serves to sort the stones into a plurality of distinct groups for working.

Depending upon the method of working of the particular automatic working machine, each stone will now be glued onto a dop, either in its centered orientation or after being inverted.

Figure 3:
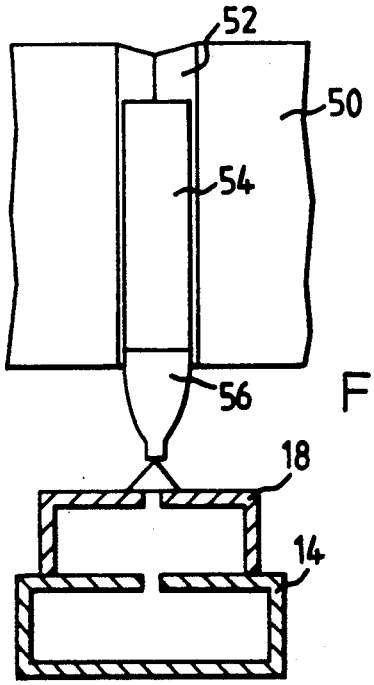
FIG. 3 is a schematic illustration of gluing apparatus constructed and operative in accordance with one embodiment of the invention.

Referring to FIG. 3, there is shown schematically the process of gluing without inversion, such as when the table side of the stone is to be worked. Ruler 14 is transferred, still under vacuum, to gluing apparatus including a dop support 50. The dop support 50 defines a plurality of parallel "V" shaped channels 52 adapted to support a dop holder 54 at the end of which a dop 56 is mounted. The dop support is disposed such that the center of each dop is precisely in registration with the center of the stone, as determined above. A dop is placed in each channel and gravity moves it into place engaging the stone, where it is glued.

Figure 4A:
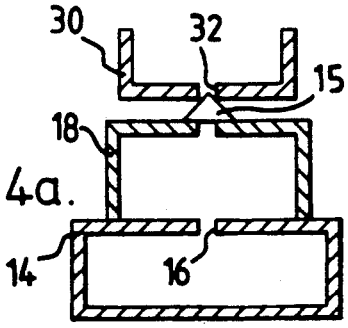
FIG. 4 is a schematic illustration of gluing apparatus constructed and operative in accordance with an alternate embodiment of the invention including inversion of the stone.
Figure 4B:
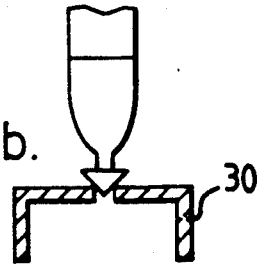

With reference to FIGS. 4*a* and 4*b*, there is shown schematically the process of gluing including inversion, such as when the culet side of the stone is to be worked. In this case, a second ruler 30 defining a plurality of apertures 32 is lowered, upside down, onto the row of stones 15 which are maintained by vacuum on stone holders 18, as shown in FIG. 4*a*. Mechanical means are provided to guide second ruler 30 into alignment with first ruler 14, and thereby ensure that each of apertures 32 is in registration with one of apertures 16 in ruler 14 such that the center of aperture 16 is in line with the center of aperture 32 which is now aligned with the axis about which the stone was centered A heat setting glue is applied to temporarily affix the stones to the ruler 30. When the glue dries, the vacuum is turned off and the ruler 30 is inverted and transferred to a dop gluing device as described above with reference to FIG. 3.

Figure 5:
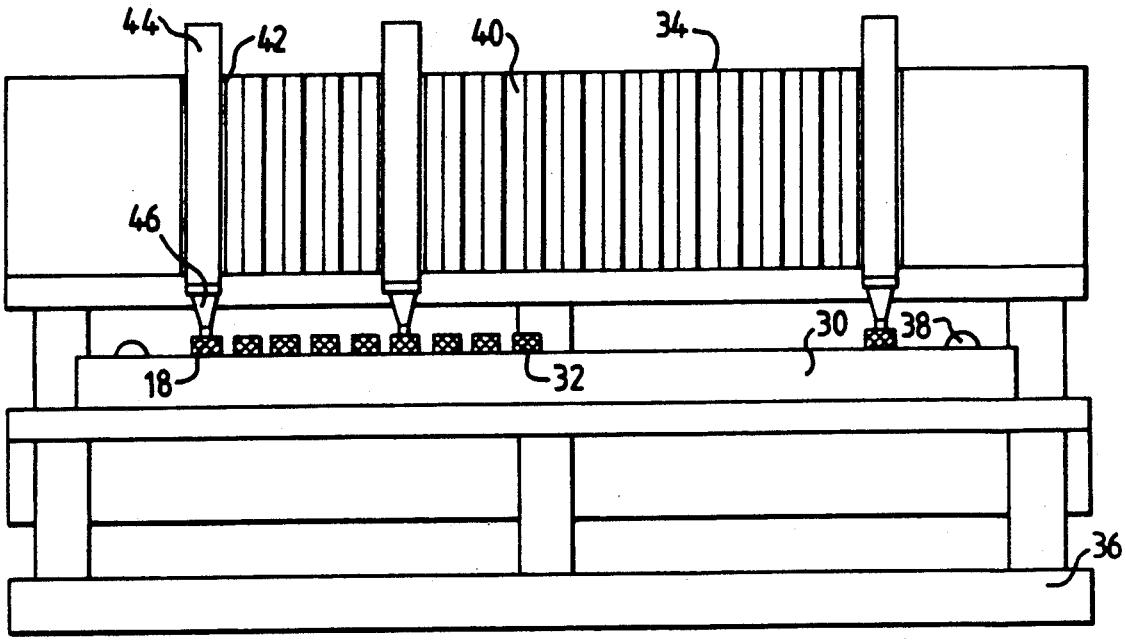
FIG. 5 is a front view of one embodiment of gluing apparatus according to the invention.
Figure 6:
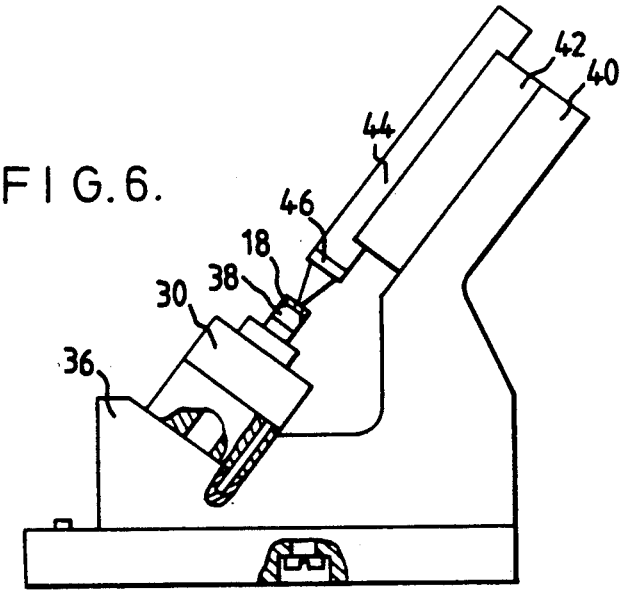
FIG. 6 is a side view of the gluing apparatus of FIG. 5.

One example of suitable dop gluing apparatus is shown in FIGS. 5 and 6. The dop gluing device 34 comprises a base 36 defining a ruler support, such as pins 38. Base 36 also defines a dop support 40. Dop support 40 includes a plurality of parallel and equally spaced "V" shaped channels 42, each adapted to support a dop holder 44 at the end of which a dop 46 is mounted. Ruler 30 is arranged to be seated on support 38 in such a way that the center of each aperture 32 is aligned with the central axis of a channel 42. In this fashion, a dop holder and dop which are seated in channel 42 and slid in the direction of stone holder 18 will engage the stone precisely in the center as determined above. Any suitable glue may be utilized to affix the stone to the dop and then the stone is removed from ruler 30 and can be stored with other stones of its category until it is to be worked in the automatic machine.

It will be appreciated by those skilled in the art that the invention is not limited to what has been shown and described hereinabove by way of example. Rather, the scope of the invention is limited solely by the claims which follow.

We claim:

1. A method for sorting and centering unfinished gem stones comprising the steps of:

viewing the stone in a direction parallel to the axis of centering and providing an image of the circumference thereof;

superimposing the image of the circumference of the stone on a reference center image;

providing a reference circumference shape centered about the reference center;

adjusting the relative size of the reference shape until it can fit within the stone; and moving the stone until it is centered about the reference center.

2. A method according to claim 1 further comprising the steps of:

recording the final size of the reference shape;

estimating the maximum possible height of the finished stone which can be made from the unfinished stone and recording this height;

comparing the selected shape, size and maximum height with a plurality of pre-determined sets of parameters; and selecting the most appropriate set of parameters for the unfinished stone in accordance therewith.

3. The method according to claim 2 further comprising the step of affixing the centered stone to the center of a dop.

4. The method according to claim 1 further comprising the step of affixing the centered stone to the center of a dop.

5. A method for sorting and centering unfinished gem stones comprising the steps of:

coupling a stone to an aperture in a base plate having suction means to retain the stone in place;

viewing the stone in a direction parallel to the axis about which it is to be centered and transmitting an image signal corresponding thereto to the circumference thereof a computer to a screen for viewing;

providing a reference center on the screen on which the image is superimposed, the reference center corresponding to the center of the aperture;

providing a reference circumference shape on the screen centered about the reference center and superimposed on the stone image;

varying the size of the reference shape until the largest shape which will fit inside the stone is determined; and moving the stone relative to the aperture until the stone image is centered about the reference center.

6. Apparatus to aid in manual centering and sorting of an unfinished gem stone comprising:

means for viewing the stone in a direction parallel to the axis on which the stone is to be centered and providing an image corresponding to the circumference thereof to a computer and associated viewing screen;

said computer comprising means for generating a reference center image, for providing a selected one of a plurality of reference circumference shapes centered about the reference center, and for superimposing the stone image on the reference center;

means for automatically changing the size of the reference shape on command of an operator until it fits within the image of the stone; and means for providing an output signal corresponding to the final size of the reference shape.

7. Apparatus according to claim 6 further comprising:

means for estimating the maximum possible height of the finished stone and for providing an output signal corresponding thereto to said computer.

8. Apparatus according to claim 7 further comprising means for sorting said centered stone by comparing the shape and final size of said reference shape, and said maximum possible height with a plurality of pre-determined sets of shape, size and height parameters and selecting therefrom the most appropriate set of parameters for the centered stone, and means for providing an output signal corresponding to said appropriate set.

9. Apparatus according to claim 8 further comprising means for affixing the centered stone on the center of a dop.

10. Apparatus according to claim 6 further comprising means for affixing the centered stone on the center of a dop.

11. Apparatus according to claim 10 wherein said means for affixing includes means for inverting the centered stone before affixing.

12. Apparatus according to claim 6 further comprising means for automatically moving a new stone into position for centering when the previous stone has been centered.

13. Apparatus for centering and sorting unfinished gem stones comprising:

a base plate defining at least one aperture coupled to a vacuum source, optical shape identification means for viewing a gem stone coupled to said aperture in a direction parallel to the axis about which said stone is to be centered and providing an output signal corresponding thereto; and computer means arranged for receiving said output signal and transmitting an image corresponding thereto to a visually observable monitor;

providing a reference center on the monitor superimposed on said image;

providing reference shapes corresponding to various configurations of circumferences of finished stones centered about the reference center and superimposed on said image with associated means for permitting alteration of the shape or relative size of the reference shape by an operator until the optimum size is reached; and receiving the signal corresponding to this shape and optimum size.

14. Apparatus according to claim 13 and further comprising means for sensing the stone perpendicular to the axis of centering and for providing a signal corresponding to the maximum height of the stone at its center to the computer means.

15. Apparatus according to claim 13 further comprising means for sensing the stone perpendicular to the axis of centering and providing a signal corresponding to the maximum height of the stone at its center to the computer means;

means for adjusting the maximum height signal by an operator and providing an output signal corresponding thereto to the computer means; and wherein said computer means is arranged to provide an output signal corresponding to one of a plurality of predetermined sets of parameters of a finished stone in response to said shape, size and height signals.

16. Apparatus according to claim 15 wherein said base plate comprises a ruler defining at least one aperture coupled to a vacuum source; the center of said at least one aperture corresponding to said reference center projected on the screen; and further comprising a stone holder associated with each said aperture and retained thereon by vacuum.

17. Apparatus according to claim 13 wherein said base plate comprises a ruler defining at least one aperture coupled to a vacuum source; the center of said at least one aperture corresponding to said reference center projected on the screen; and further comprising a stone holder associated with each said aperture and retained thereon by vacuum.

18. Apparatus according to claim 17 comprising a plurality of apertures arranged for serial viewing by the viewer means and further comprising means for advancing the ruler so that one stone is viewed after the other.

19. Apparatus according to claim 18 and wherein said means for advancing the ruler is automatically controlled by the computer and actuated by the operator.

20. Apparatus according to claim 19 further comprising means for gluing a centered gem stone on a dop comprising:

a ruler support; and dop support means disposed such that the longitudinal axis of a dop supported thereon intersects the center of one said aperture in the ruler when the ruler is mounted in the ruler support.

21. Apparatus according to claim 17 further comprising means for gluing a centered gem stone on a dop comprising:

a ruler support; and dop support means disposed such that the longitudinal axis of a dop supported thereon intersects the center of one said aperture in the ruler when the ruler is mounted in the ruler support.

22. Apparatus according to claim 21 and further comprising a second ruler defining at least one aperture disposable in registration with the at least one aperture of the first ruler, the second ruler arranged to be inverted before mounting on the ruler support for gluing the stones n an inverted orientation.

23. A method for sorting and centering unfinished gem stones comprising the steps of:

viewing the stone in a direction parallel to the axis of centering and providing an image of the circumference thereof to a CPU in relation to said centering axis;

automatically generating reference circumference shapes each centered about said centering axis;

fitting within said stone image individual ones of said reference shapes until an optimal one thereof is determined;

receiving a set of coordinates associated with said determined reference shape relating its displacement from said centering axis; and moving said stone towards the centering axis in accordance with said received set of coordinates.

* * * * *